US011098727B2

(12) United States Patent
Kalgraff

(10) Patent No.: US 11,098,727 B2
(45) Date of Patent: Aug. 24, 2021

(54) COUNTER ROTATING BACK-TO-BACK FLUID MOVEMENT SYSTEM

(71) Applicant: ONESUBSEA IP UK LIMITED, London (GB)

(72) Inventor: Simon Kalgraff, Bergen (NO)

(73) Assignee: ONESUBSEA IP UK LIMITED, London (GB)

( * ) Notice: Subject to any disclaimer, the term of this patent is extended or adjusted under 35 U.S.C. 154(b) by 206 days.

(21) Appl. No.: 16/012,952

(22) Filed: Jun. 20, 2018

(65) Prior Publication Data

US 2019/0390683 A1 Dec. 26, 2019

(51) Int. Cl.

| | |
|---|---|
| ***F04D 29/051*** | (2006.01) |
| ***E21B 43/017*** | (2006.01) |
| ***F04D 19/02*** | (2006.01) |
| ***F04D 25/06*** | (2006.01) |
| ***F04D 29/58*** | (2006.01) |

(52) U.S. Cl.

CPC ..... *F04D 29/051* (2013.01); *E21B 43/017* (2013.01); *F04D 19/024* (2013.01); *F04D 25/06* (2013.01); *F04D 29/582* (2013.01)

(58) Field of Classification Search

CPC ..... F04D 29/051; F04D 19/024; F04D 13/12; F04D 25/16; F04D 25/0686; F04D 13/08; F01D 3/02; F01D 3/04; F01D 5/03

See application file for complete search history.

(56) References Cited

U.S. PATENT DOCUMENTS

| | | | | |
|---|---|---|---|---|
| 1,947,477 | A * | 2/1934 | Lysholm | F04D 25/04 417/247 |
| 2,406,959 | A * | 9/1946 | Millard | F04D 13/10 417/423.6 |
| 9,004,177 | B2 * | 4/2015 | Hatton | E21B 43/36 166/345 |
| 9,476,427 | B2 * | 10/2016 | Torkildsen | F04D 25/0686 |
| 2011/0290498 | A1 * | 12/2011 | Hatton | E21B 43/017 166/345 |
| 2014/0147243 | A1 * | 5/2014 | Torkildsen | F04D 25/0686 415/1 |

(Continued)

FOREIGN PATENT DOCUMENTS

| | | | | |
|---|---|---|---|---|
| DE | 870594 C | 3/1953 | | |
| WO | WO-03031823 A1 * | 4/2003 | | F04D 25/16 |

(Continued)

OTHER PUBLICATIONS

European Search Report issued in European Patent Appl. No. 19181269.2 dated Nov. 5, 2019; 11 pages.

*Primary Examiner* — Eldon T Brockman
(74) *Attorney, Agent, or Firm* — Eileen Pape

(57) ABSTRACT

A technique facilitates movement of fluids while reducing axial loading on system components such as thrust bearings. The technique utilizes a system, e.g. a compressor, for moving fluid via counter rotating rotors. By way of example, the rotors may utilize impellers for establishing opposed fluid flows along fluid movement sections. The fluid movement sections may be arranged in a back-to-back configuration such that counter rotation of the rotors causes the impellers to move fluid flows in opposed directions, thus reducing axial loading. The opposed fluid flows ultimately are redirected to an outlet.

16 Claims, 2 Drawing Sheets

(56) References Cited

U.S. PATENT DOCUMENTS

| | | | | |
|---|---|---|---|---|
| 2017/0306966 | A1* | 10/2017 | Valland | F04D 29/047 |
| 2019/0145415 | A1* | 5/2019 | Brunvold | F04D 3/00<br>417/423.12 |

FOREIGN PATENT DOCUMENTS

| | | | |
|---|---|---|---|
| WO | WO2014083055 | A2 | 6/2014 |
| WO | WO2014083055 | A3 | 6/2014 |

* cited by examiner

COUNTER ROTATING BACK-TO-BACK FLUID MOVEMENT SYSTEM

BACKGROUND

Hydrocarbon fluids such as natural gas and oil are obtained from a subterranean geologic formation, referred to as a reservoir, by drilling a well that penetrates the hydrocarbon-bearing geologic formation. In many types of land-based applications and subsea applications, the fluids are moved, e.g. pumped, from one location to another. Various types of systems for moving fluid are employed at subsea locations, subterranean locations, and land-based locations. For example, various types of compressors may be used to move dry gases or mixed phase fluids to desired collection locations or other locations. During operation of the compressor/pump substantial axial loads may be created on thrust bearing assemblies and these axial loads can cause excessive wear or cause limitations to be placed on compressor differential pressure capacity.

SUMMARY

In general, a system and methodology are provided for moving fluids while reducing axial loading on system components such as thrust bearings. The technique utilizes a system for moving fluid, e.g. a compressor, with counter rotating impellers deployed along fluid movement sections. The fluid movement sections may be arranged in a back-to-back configuration such that operation of the fluid movement sections causes the impellers to move fluid flows in opposed directions, thus reducing axial loading. The opposed fluid flows ultimately are redirected to an outlet.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
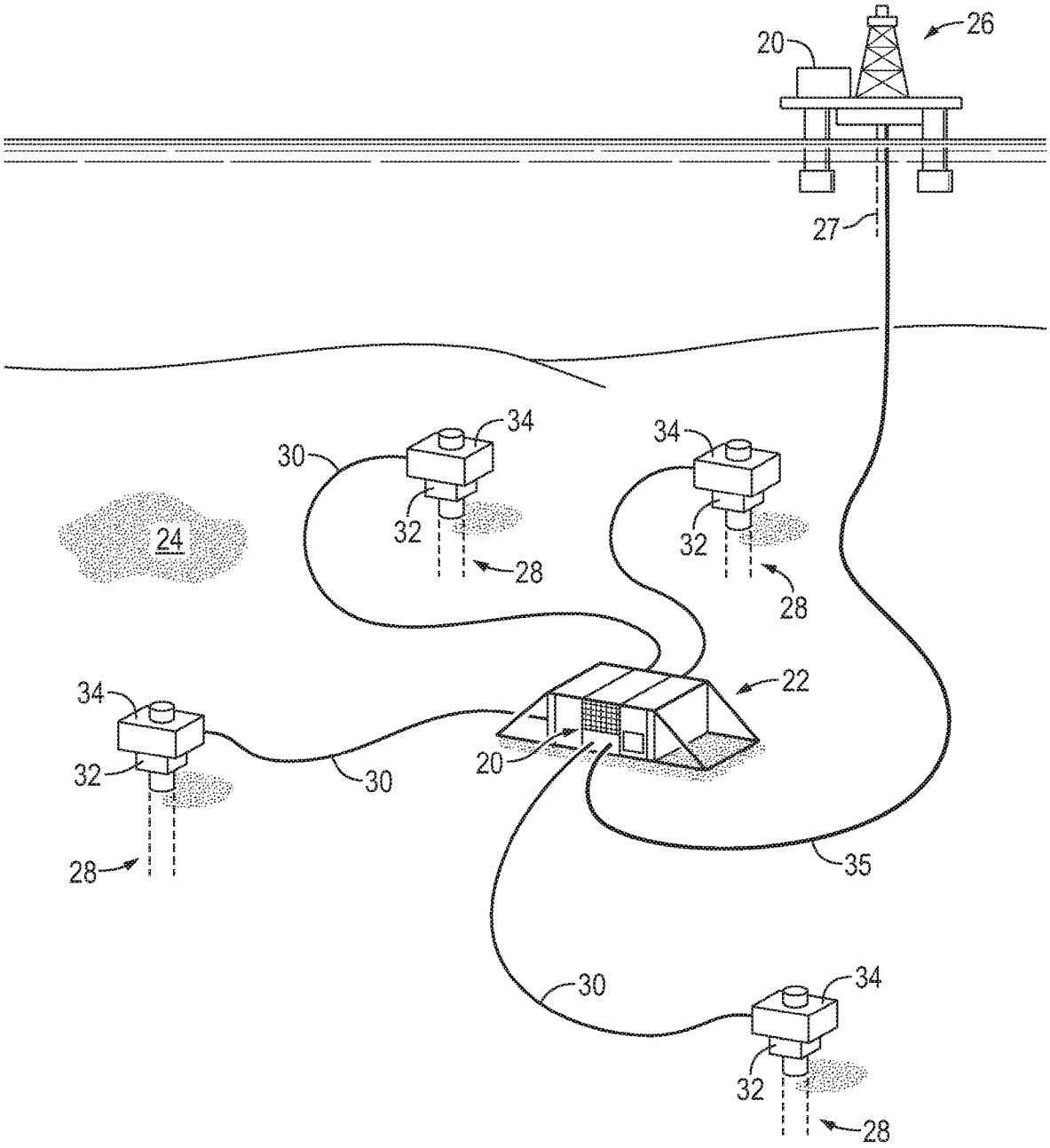
FIG. 1 is a schematic illustration of an example of a subsea system having fluid movement systems, e.g. compressors, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate movement of fluids, e.g. dry gases or multiphase fluids. The fluid movement system enables a reduction in axial loading on system components such as thrust bearings without reducing flow and differential pressure capacity. According to an embodiment, the system may be a compressor (or other type of pump) which moves the fluid via counter rotating rotors having impellers.

By way of example, the impellers may be interleaved and counter rotated to establish the desired fluid flows. The fluid movement sections may be arranged in a back-to-back configuration such that operation of the compression sections causes the impellers to move fluid flows in opposed directions. By moving fluid in opposed directions, the resulting thrust created by the impellers acts in opposed directions thus reducing net axial loading on bearings and other system components. The opposed fluid flows ultimately are redirected to an outlet.

According to one example, the fluid movement system is in the form of a counter rotating back-to-back axial compressor. The axial compressor comprises two compressor rotors driven by, for example, electric motors. Examples of suitable electric motors include oil filled motors which each contain barrier oil for lubrication and for protection from environmental fluids and conditions.

The electric motors may be used to drive compressor rotors rotatably mounted in compressor rotor bearing systems. The compressor rotor bearing systems also may be oil filled and may be constructed to share the barrier oil with the corresponding electric motors via common oil volumes and circuits. In some embodiments, barrier oil may be moved through the electric motors and corresponding rotor bearing systems via a circulation impeller, via external pumps, or by other suitable mechanisms. The barrier oil may be cooled by a suitable heat exchanger. Additionally, the barrier oil may be kept at a higher pressure relative to process fluid pressures and ambient pressures. In other embodiments, however, the electric motors may be in the form of dry motors which work in combination with compressor rotor bearing systems. In such embodiments, the compressor rotor bearing systems may be oil filled, partially oil filled, spray lubricated, or magnetic bearings exposed to process media.

Depending on the parameters of specific operations, the back-to-back compressor sections may be arranged in series or in parallel. In some embodiments, e.g. certain series configuration embodiments, a process cooler may be installed to cool the fluid being pumped or otherwise moved via the compressor. Depending on the embodiment, the compressor may be a vertical compressor or a horizontal compressor and a dry gas compressor or multiphase compressor. The compressor also may be used in a variety of environments, including subsea environments and surface environments both on land and offshore.

Referring generally to FIG. 1, examples of a fluid movement system 20 are illustrated at different locations. For example, the fluid movement system 20 may be used at a subsea location in a corresponding subsea installation 22 located at a sea floor 24. However, the fluid movement system 20 also may be used at a surface location, e.g. a land-based location or offshore location. In the illustrated example, the surface based fluid movement system 20 is illustrated as part of a surface facility 26, e.g. a surface vessel or platform. It should be noted the fluid movement system or systems 20 may be used in a variety of subsea environments, land-based environments, or other surface environments to facilitate movement of fluids, e.g. dry gases or multiphase fluids.

Various subsea components may be deployed along the sea floor 24 and may comprise manifolds, pumping stations, wellhead installations, and many other types of subsea components. Electric power may be provided to the subsea fluid movement system 20 and/or other subsea components via a power cable 27. In the embodiment illustrated, subsea installation 22 comprises fluid movement system 20 and is connected with a plurality of wells 28 by suitable flow lines 30, e.g. pipes. In some embodiments, the flow lines 30 may be coupled with a manifold which, in turn, is connected with the fluid movement system 20, e.g. compressor, at subsea installation 22. Hydrocarbon bearing fluid may be produced from wells 28, up through corresponding wellheads 32 and Christmas trees 34, and on to the subsea installation 22 via the flow lines 30.

The hydrocarbon bearing fluid, e.g. dry gas or multiphase fluid, may be routed to the surface facility 26 via a suitable flow line 35. Depending on the operation, at least one additional fluid movement system 20 may be positioned at the surface facility 26, as illustrated, to facilitate movement of well fluids to a desired collection location. However, different numbers and arrangements of fluid movement systems 20 may be used in a variety of subsea operations. The fluid movement systems 20 also may be used in various land-based operations to provide desired flows of hydrocarbon-based fluids or other types of fluids.

Figure 2:
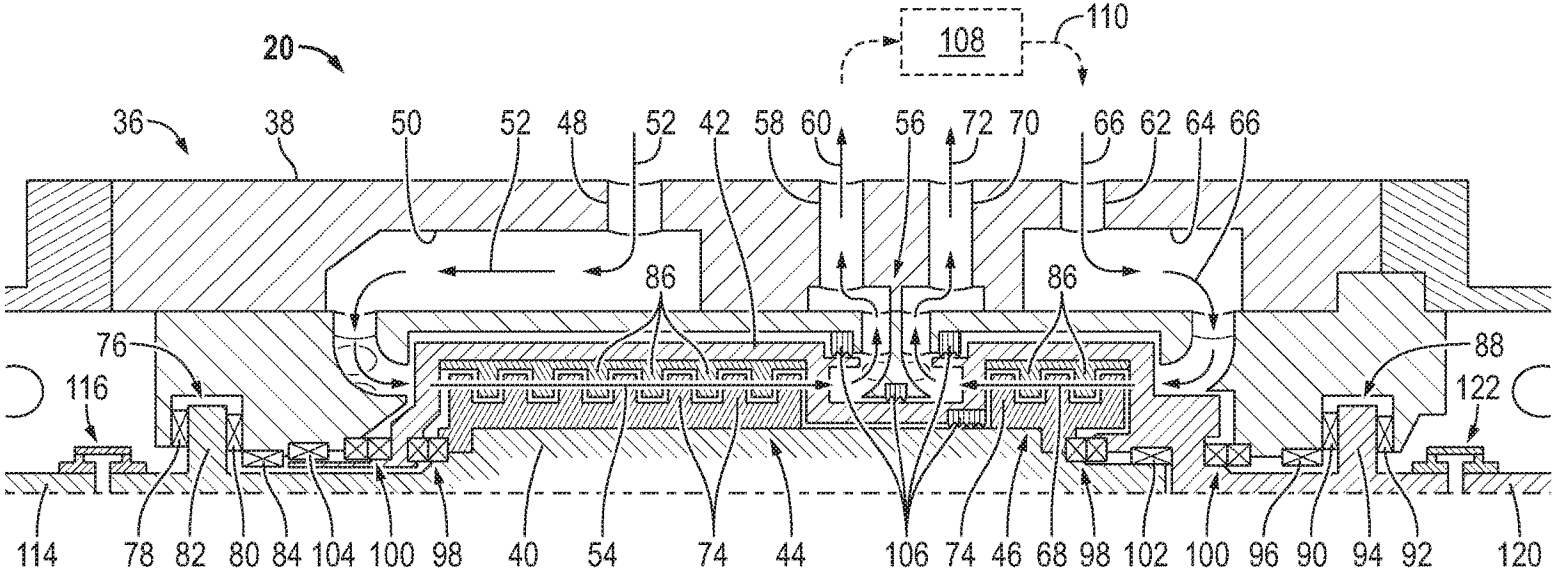
FIG. 2 is a schematic cross-sectional illustration of an example of a portion of a fluid movement system, according to an embodiment of the disclosure.

Referring generally to FIG. 2, an example of fluid movement system 20 is illustrated. The fluid movement system 20 is illustrated in the form of a compressor for pumping dry gases or multiphase fluids. However, the fluid movement system 20 also may be constructed to pump liquids in some applications.

In the embodiment illustrated, the fluid movement system 20 comprises a counter rotating axial compressor 36 having an outer housing 38, an inner rotor 40, and an outer rotor 42. The inner rotor 40 and outer rotor 42 are arranged to form a first fluid movement section 44, e.g. a first compressor section, and a second fluid movement section 46, e.g. a second compressor section. The first fluid movement section 44 and the second fluid movement section 46 are oriented to move fluid, e.g. a dry gas or other compressible fluid, in opposed axial directions. By moving flows of fluid in opposed axial directions along the first section 44 and the second section 46, respectively, axial loading on system components is reduced. In other words, the thrust generated during pumping of fluid is directed in two opposed directions which reduces the net axial loading in a single axial direction.

Referring again to FIG. 2, the first fluid movement section 44 may be arranged to draw in fluid through a first inlet 48 in outer housing 38. By way of example, the fluid may flow through inlet 48, through a first inlet mixer volume 50, and to the inner and outer rotors 40, 42 of first fluid movement section 44 as represented by arrows 52. The fluid is then moved, e.g. pumped, in an axial direction along the first fluid movement section 44 as represented by arrow 54. The fluid is subsequently redirected radially outwardly via a fluid outlet section 56 which, in turn, directs the fluid flow out through a fluid outlet 58 extending through outer housing 38 as represented by arrow 60.

Similarly, the second fluid movement section 46 may be arranged to draw in fluid through a second inlet 62 in outer housing 38. The fluid may flow through second inlet 62, through a second inlet mixer volume 64, and to the inner and outer rotors 40, 42 of second fluid movement section 46 as represented by arrows 66. The fluid is then moved, e.g. pumped, in an axial direction along the second fluid movement section 44 as represented by arrow 68. The fluid is redirected radially outwardly via the fluid outlet section 56 which, in turn, directs the fluid flow out through a fluid outlet 70 extending through outer housing 38 as represented by arrow 72. It should be noted the positioning of the inlets and other system components may be adjusted for different embodiments and applications. For example, if the fluid movement system 20 is used as a vertical machine with section 44 as the lower section, the position of second inlet 62 may be shifted. In this type of vertical system application, the second inlet 62 may be moved to the right in FIG. 2 such that flow in second inlet mixer volume 64 is downward.

In this example, the fluid inlets 48, 62 are axially outlying relative to the fluid outlets 58, 70. Consequently, the fluid flows 54, 68 move through fluid movement sections 44, 46 in axially opposed directions toward each other. In other embodiments, the fluid movement sections 44, 46 may be arranged such that the fluid flows move in axially opposed directions away from each other. Regardless, the thrust created in fluid movement section 44 is oriented in a direction opposed to the thrust created in fluid movement section 46, thus reducing axial loading on system components such as thrust bearings.

The inner rotor 40 may comprise or be combined with an inner impeller 74, e.g. a plurality of inner impellers 74. Additionally, the inner rotor 40 may be secured axially by an inner rotor thrust bearing assembly 76 so as to counter axial thrust loading resulting from operation of first fluid movement section 42. By way of example, the inner rotor thrust bearing assembly 76 may comprise an inner rotor main thrust bearing 78, an inner rotor reverse thrust bearing 80, and an inner rotor thrust disc 82 located therebetween. A radial bearing 84, e.g. an inner rotor drive end radial bearing, also may be positioned proximate the inner rotor thrust bearing assembly 76 to provide radial support.

Similarly, the outer rotor 42 may comprise or be combined with an outer impeller 86, e.g. a plurality of outer impellers 86. The impellers 86 may be interleaved with the inner impellers 74 through both first fluid movement section 44 and second fluid movement section 46. The outer rotor 42 may be secured axially by an outer rotor thrust bearing assembly 88 so as to counter axial thrust loading resulting from operation of second fluid movement section 46.

By way of example, the outer rotor thrust bearing assembly 88 may comprise an outer rotor main thrust bearing 90, an outer rotor reverse thrust bearing 92, and an outer rotor thrust disc 94 located therebetween. Additionally, a radial bearing 96, e.g. an outer rotor drive end radial bearing, may be positioned proximate the outer rotor thrust bearing assembly 88 to provide radial support.

Other features may comprise counter rotating mechanical seals 98 positioned between the inner rotor 40 and outer rotor 42 in both the first fluid movement section 44 and second fluid movement section 46. Additionally, single rotating mechanical seals 100 may be positioned between the outer rotor 42 and the housing 38 in both the first fluid movement section 44 and the second fluid movement section 46 as illustrated.

Various additional bearings also may be added to the fluid movement system 20. For example, a counter rotating radial bearing 102 may be positioned between rotors 40, 42 and a radial end bearing 104 may be positioned between outer rotor 42 and housing 38. A plurality of seals 106, e.g. labyrinth seals, may be positioned between outer rotor 42 and inner rotor 40 and also between outer rotor 42 and corresponding surfaces of housing 38 proximate fluid outlet section 56.

In some embodiments, the gas or other fluid moved via impellers 74, 86 may be routed to a process cooler 108. According to an example, the process cooler 108 may be located to receive the process fluid from fluid outlet 58 and to direct the process fluid back into second inlet 62, as represented by arrow 110. It should be noted the process cooler 108 may be omitted or may be placed at other locations along the flow of process fluids. In some embodiments, the process cooler 108 may be installed with a bypass line and fluid flow therethrough may be controlled via valves.

By directing fluid flows 54, 68 in opposed axial directions, the fluid movement system 20 is able to generate a higher process differential pressure (dp) without generating additional load on the thrust bearing assemblies 76, 88. This enables application of higher differential pressures to the process fluid without increasing the load limits of the thrust bearings. Arrangement of the first and second fluid movement sections 44, 46 in a back-to-back configuration ensures the axial forces generated by the impellers 74, 86 are balanced to some extent.

Within the counter rotating axial compressor 36, the impellers 74, 86 in first fluid movement section 44 generate trust forces in a left direction in FIG. 2. The impellers 74, 86 in the second fluid movement section 46 generate thrust forces in the right direction in FIG. 2 and these forces in the left and right directions counter each other to a desired level. For example, the number of impellers 74, 86 in each fluid movement section 44, 46 as well as the hydraulic design of the impellers may be varied to adjust the level of thrust force balancing and to ensure continuous loading on the desired thrust bearings within the thrust bearing load limits.

With respect to the embodiment illustrated in FIG. 2, for example, the impellers 74, 86 may be constructed so that the resultant or net thrust forces point to the left and apply loads to the main thrust bearings 78, 90. However, the impellers may be selected to create other desired resultant or net thrust forces.

It should be noted the fluid movement sections 44, 46 may be aligned axially or arranged in axially offset positions. In some embodiments, the fluid movement sections 44, 46 may be arranged in parallel configurations.

Figure 3:
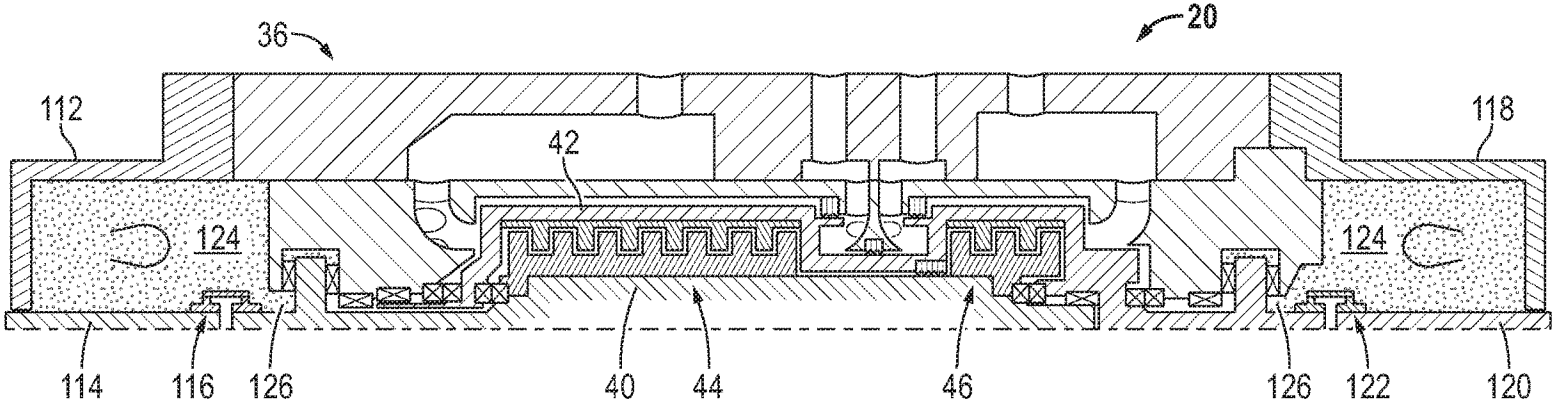
FIG. 3 is a schematic cross-sectional illustration similar to that of FIG. 2 but combined with electric motors for powering the fluid movement system, according to an embodiment of the disclosure.

With additional reference to FIG. 3, each rotor 40, 42 may be coupled to a motive unit which causes rotation of the corresponding rotor. By way of example, the rotors 40, 42 may be coupled to an electric motor, hydraulic motor, or other motive unit through a suitable transmission. In other embodiments, each rotor 40, 42 may be coupled to a dedicated motive unit. In the embodiment illustrated in FIG. 3, inner rotor 40 is coupled to a corresponding electric motor 112 via a motor shaft 114 and corresponding coupling 116. Similarly, outer rotor 42 is coupled to a corresponding electric motor 118 via a motor shaft 120 and corresponding coupling 122. The motors 112, 118 may be operated to rotate shafts 114, 120 in opposite directions to cause counter rotation of inner rotor 40 and outer rotor 42.

In this embodiment, a motor oil 124, e.g. a barrier oil, is disposed in each electric motor 112 and 118. In some embodiments, the electric motors 112, 118 may be placed in fluid communication with corresponding bearing assemblies via suitable barrier oil circuits 126. This enables sharing of the barrier oil 124 between the electric motors 112, 118 and at least some of the internal bearings.

However, the motors 112, 118 also may comprise dry motors or other types of motors and the desired bearing assemblies may be filled with dedicated oil, partially oil filled, spray lubricated, or otherwise lubricated. Additionally, the counter rotating axial compressor 36 (or other fluid movement system 20) may be arranged vertically or horizontally and may be in the form of a dry gas compressor, multiphase fluid compressor, and/or other type of fluid movement system.

Depending on the parameters of a given operation, the fluid movement system 20 may be used with many types of devices and systems. The type, size, and arrangement of components within each fluid movement system 20 also may be selected according to the quantities and types of process fluids to be moved, the environment in which the system is operated, and other operational parameters. Additional components also may be used in some embodiments of fluid movement system 20. For example, a fluid mixer section or sections may employ a mixer device, e.g. a mixer pipe, to split and then re-mix the liquid and gas phases in the process media.

The length, type, and arrangement of impellers also may change depending on the characteristics of the fluid being moved, e.g. pumped, as well as the environment in which system 20 is utilized. The impellers may be constructed in many configurations and may comprise various features selected to facilitate pumping of dry gas, multiphase fluid, and/or liquid. The configuration of the rotors, outer housing, bearings, and other features may be selected according to the parameters of a given operation or operations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for moving a compressible fluid, comprising:

a counter rotating axial compressor having:

an inner rotor comprising a plurality of inner impellers, the inner rotor being secured axially by an inner rotor thrust bearing assembly; and an outer rotor comprising a plurality of outer impellers interleaved with the inner impellers, the outer impellers being secured axially via an outer rotor thrust bearing assembly, the outer rotor being rotatable in an opposite direction relative to the inner rotor to draw in the compressible fluid;

the inner rotor and the outer rotor forming a first compressor section wherein inner and outer impellers are interleaved and a second compressor section wherein inner and outer impellers are interleaved, the first and second compressor sections being oriented to move the compressible fluid in opposed axial directions along the first compressor section and the second compressor section, respectively, so as to reduce axial loading incurred by the inner rotor thrust bearing assembly and the outer rotor thrust bearing assembly.

2. The system as recited in claim 1, wherein the inner rotor thrust bearing assembly comprises an inner rotor main thrust bearing, an inner rotor reverse thrust bearing, and an inner rotor thrust disc therebetween.

3. The system as recited in claim 2, wherein the outer rotor thrust bearing assembly comprises an outer rotor main thrust bearing, an outer rotor reverse thrust bearing, and an outer rotor thrust disc therebetween.

4. The system as recited in claim 1, wherein rotation of the inner rotor and the outer rotor in opposite directions causes the first compressor section to draw in the compressible fluid through a first compressor inlet and to discharge the compressible fluid through a first compressor outlet.

5. The system as recited in claim 4, wherein rotation of the inner rotor and the outer rotor in opposite directions causes the second compressor section to draw in the compressible fluid through a second compressor inlet and to discharge the compressible fluid through a second compressor outlet.

6. The system as recited in claim 5, wherein the compressible fluid discharged through the first compressor outlet is directed into the second compressor inlet.

7. The system as recited in claim 1, wherein the first compressor section and the second compressor section are aligned axially.

8. The system as recited in claim 1, further comprising a process cooler through which the compressible fluid is directed to cool the compressible fluid.

9. The system as recited in claim 1, wherein the counter rotating axial compressor is a multiphase fluid compressor.

10. The system as recited in claim 1, wherein the counter rotating axial compressor is a dry gas compressor.

11. A system for moving a fluid, comprising:

an inner rotor having a plurality of inner impellers, the inner rotor being secured axially by an inner rotor thrust bearing assembly; and an outer rotor having a plurality of outer impellers interleaved with the inner impellers, the outer impellers being secured axially via an outer rotor thrust bearing assembly, the outer rotor being rotatable in an opposite direction relative to the inner rotor to draw in the fluid;

the inner rotor and the outer rotor forming a first fluid movement section wherein inner and outer impellers are interleaved and a second fluid movement section wherein inner and outer impellers are interleaved, the first and second fluid movement sections being oriented to move the fluid in opposed axial directions along the first fluid movement section and the second fluid movement section, respectively, so as to reduce axial loading incurred by the inner rotor thrust bearing assembly and the outer rotor thrust bearing assembly.

12. The system as recited in claim 11, wherein the first fluid movement section is a first compressor section and the second fluid movement section is a second compressor section.

13. The system as recited in claim 12, wherein the inner rotor thrust bearing assembly comprises an inner rotor main thrust bearing, an inner rotor reverse thrust bearing, and an inner rotor thrust disc therebetween.

14. The system as recited in claim 13, wherein the outer rotor thrust bearing assembly comprises an outer rotor main thrust bearing, an outer rotor reverse thrust bearing, and an outer rotor thrust disc therebetween.

15. The system as recited in claim 11, wherein the inner rotor and the outer rotor are powered via at least one electric motor.

16. The system as recited in claim 11, wherein the inner rotor and the outer rotor are each powered via a corresponding electric motor.

* * * * *